US007793809B2

(12) United States Patent
Howell

(10) Patent No.: US 7,793,809 B2
(45) Date of Patent: Sep. 14, 2010

(54) BACKPACK FRAME

(76) Inventor: Frank A. Howell, 15 Cotton La., Oxford, ME (US) 04270

( * ) Notice: Subject to any disclaimer, the term of this patent is extended or adjusted under 35 U.S.C. 154(b) by 308 days.

(21) Appl. No.: 11/959,664

(22) Filed: Dec. 19, 2007

(65) Prior Publication Data

US 2008/0149677 A1 Jun. 26, 2008

Related U.S. Application Data

(60) Provisional application No. 60/870,995, filed on Dec. 20, 2006.

(51) Int. Cl.
*A45F 3/08* (2006.01)

(52) U.S. Cl. ..... 224/628; 224/633; 224/635; 224/261; 224/263

(58) Field of Classification Search ..... 224/628, 224/630, 633–637, 261–263, 907; D3/216
See application file for complete search history.

(56) References Cited

U.S. PATENT DOCUMENTS

| | | | | | |
|---|---|---|---|---|---|
| 4,074,839 | A | * | 2/1978 | Wood et al. | 224/635 |
| 4,087,031 | A | * | 5/1978 | Fenner | 224/602 |
| 4,135,654 | A | * | 1/1979 | Chu | 224/261 |
| 5,553,759 | A | * | 9/1996 | McMaster et al. | 224/631 |
| 5,564,612 | A | * | 10/1996 | Gregory | 224/633 |
| 5,762,243 | A | * | 6/1998 | McMaster et al. | 224/262 |
| D426,700 | S | * | 6/2000 | Gregory | D3/216 |
| 6,607,107 | B2 | * | 8/2003 | Dexheimer | 224/604 |
| 2006/0163305 | A1 | | 7/2006 | Tong | |
| 2006/0208024 | A1 | | 9/2006 | Gleason | |

FOREIGN PATENT DOCUMENTS

| | | | |
|---|---|---|---|
| CH | 332019 | A * | 9/1958 |
| DE | 19932498 | A1 * | 2/2001 |
| DE | 102004032158 | A1 * | 1/2006 |
| EP | 273087 | A1 * | 7/1988 |
| EP | 979625 | A1 * | 2/2000 |

* cited by examiner

*Primary Examiner*—Nathan J Newhouse
*Assistant Examiner*—John Cogill
(74) *Attorney, Agent, or Firm*—Gauthier & Connors LLP

(57) ABSTRACT

A backpack frame has a front side and a back side and comprises generally parallel base and top sections that extend transversely across and are spaces one from the other along a center line of the frame. Side rails connect the base section to the top section. The side rails are arranged on opposite sides of the frame center line, and a stabilizing rib interconnects the side rails and extends transversely across the center line at an intermediate location between the base and top sections. The side rails converge inwardly from the base section towards the frame center line to the stabilizing rib, and diverge outwardly from the stabilizing rib and away from the center line to the top section.

9 Claims, 8 Drawing Sheets

BACKPACK FRAME

CROSS REFERENCE TO RELATED APPLICATION

This application claims priority from provisional patent application Ser. No. 60/870,995 filed Dec. 20, 2006.

BACKGROUND

1. Field of the Invention

This invention relates to flexible frames for backpacks and the like.

2. Description of the Prior Art

Flexible backpack frames are known, one example being that described in U.S. patent application Ser. No. 11/141,354 (Pub. No. US 2006/0266781 A1), hereinafter referred to as the "prior backpack frame."

SUMMARY OF THE INVENTION

Among the objectives of the present invention is the strategic narrowing of the prior backpack frame to thereby accommodate increased movement of the wearer's shoulders, scapulas and forearms, thus facilitating backward and sideward reaching.

Another objective of the present invention is to achieve the aforesaid narrowing while maximizing the useful load bearing area of the backpack frame.

Still another objective of the present invention is to increase load stabilization by minimizing the degree to which the load will sway from side to side as the wearer walks or runs.

These and other objectives, features, and advantages of the present invention will now be described in further detail with reference to the accompanying drawings, wherein:

DETAILED DESCRIPTION

Figure 1:
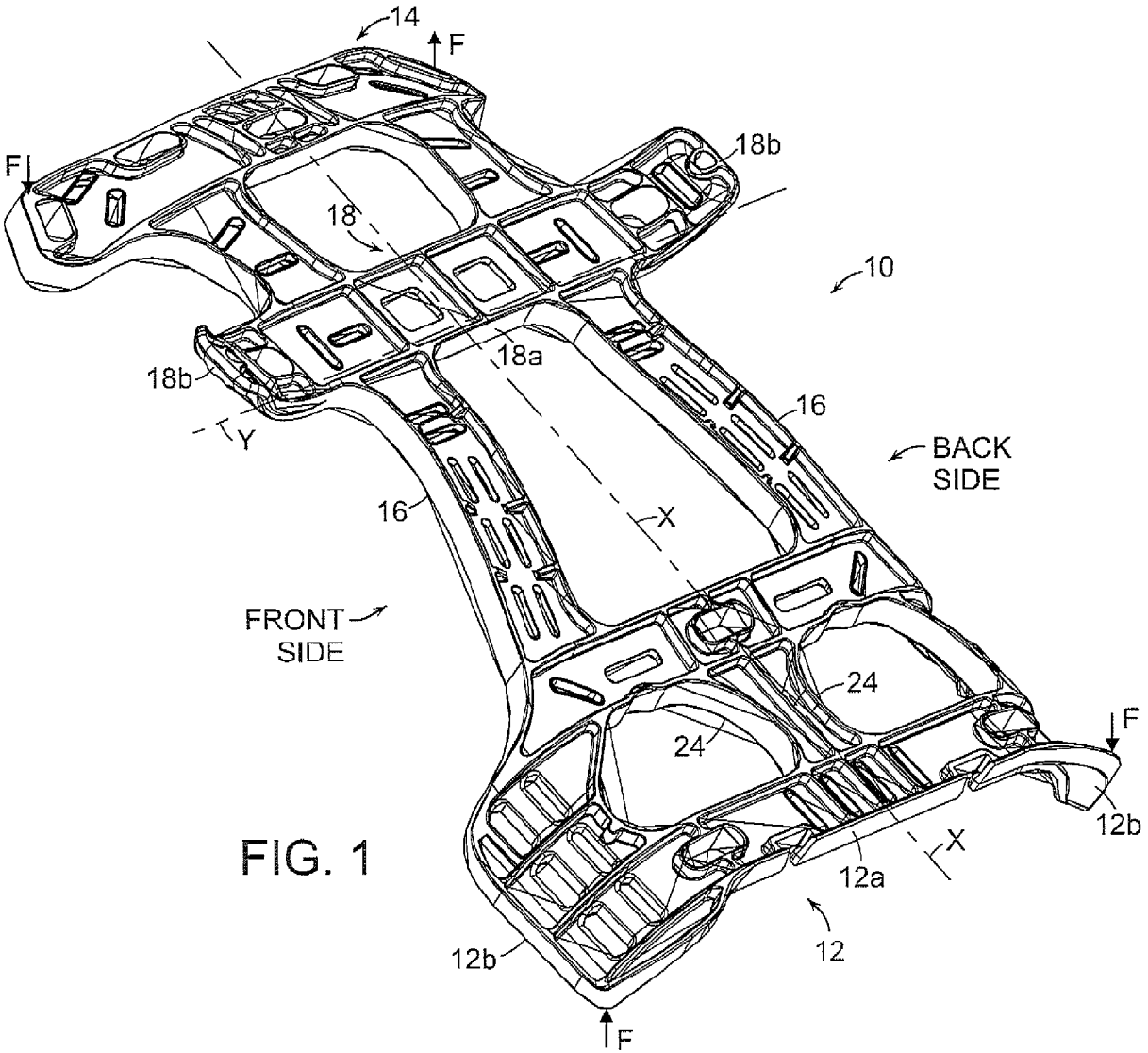
FIG. 1 is a back perspective view of a backpack frame in accordance with the present invention.

With reference initially to FIG. 1, a backpack frame 10 in accordance with the present invention comprises an integral structure having a "front side" and a "back side". The backpack frame has generally parallel base and top sections 12, 14 extending transversely across and spaced one from the other along a frame center line "X". Side rails 16 are arranged on opposite sides of the center line to connect the base section 12 to the top section 14. A stabilizing rib 18 interconnects the side rails and extends transversely across the center line at an intermediate location between the base and top sections 12, 14. The side rails 16 converge inwardly from the base section 12 towards the center line X to the stabilizing rib 18, and diverge outwardly from the stabilizing rib and away from the center line to the top section 14.

Figure 6:
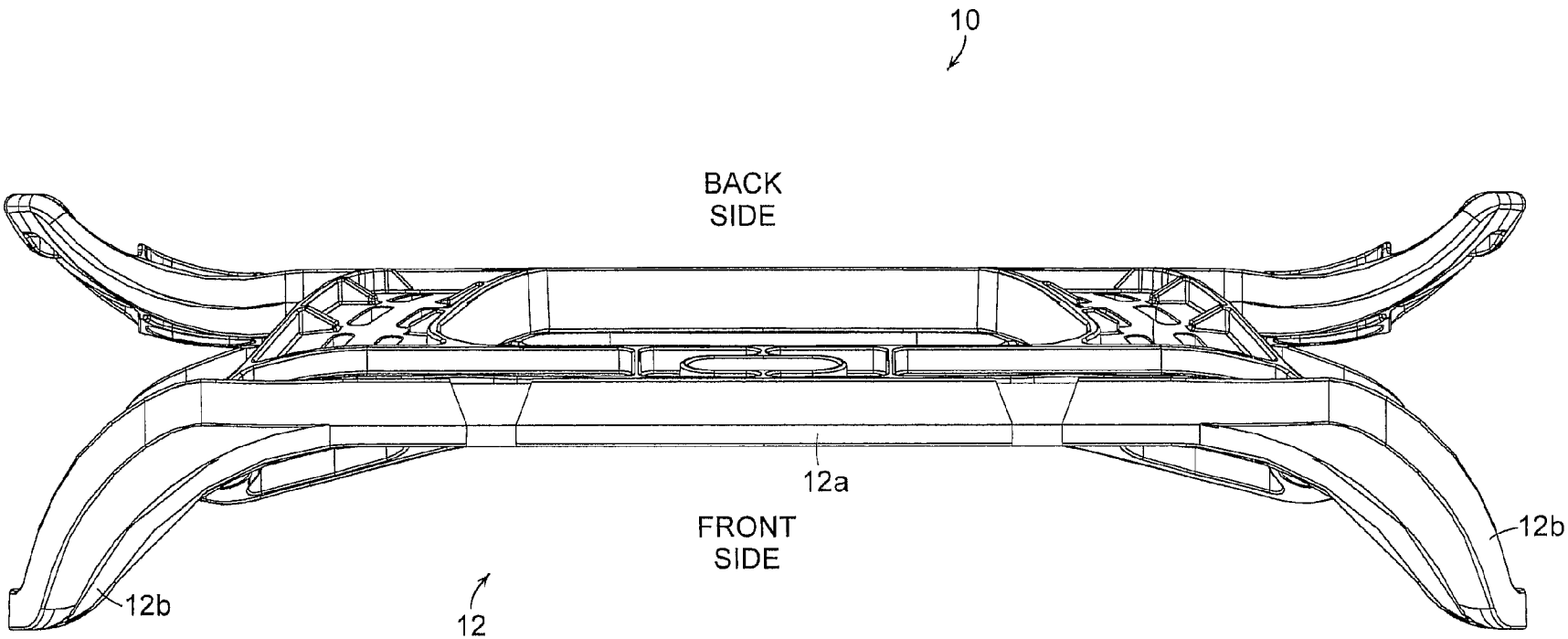

With reference additionally to FIG. 6, it will be seen that the base section 12 has a substantially flat central area **12*a* with end segments 12*b*** curving forwardly towards the front side of the backpack frame.

Figure 5:
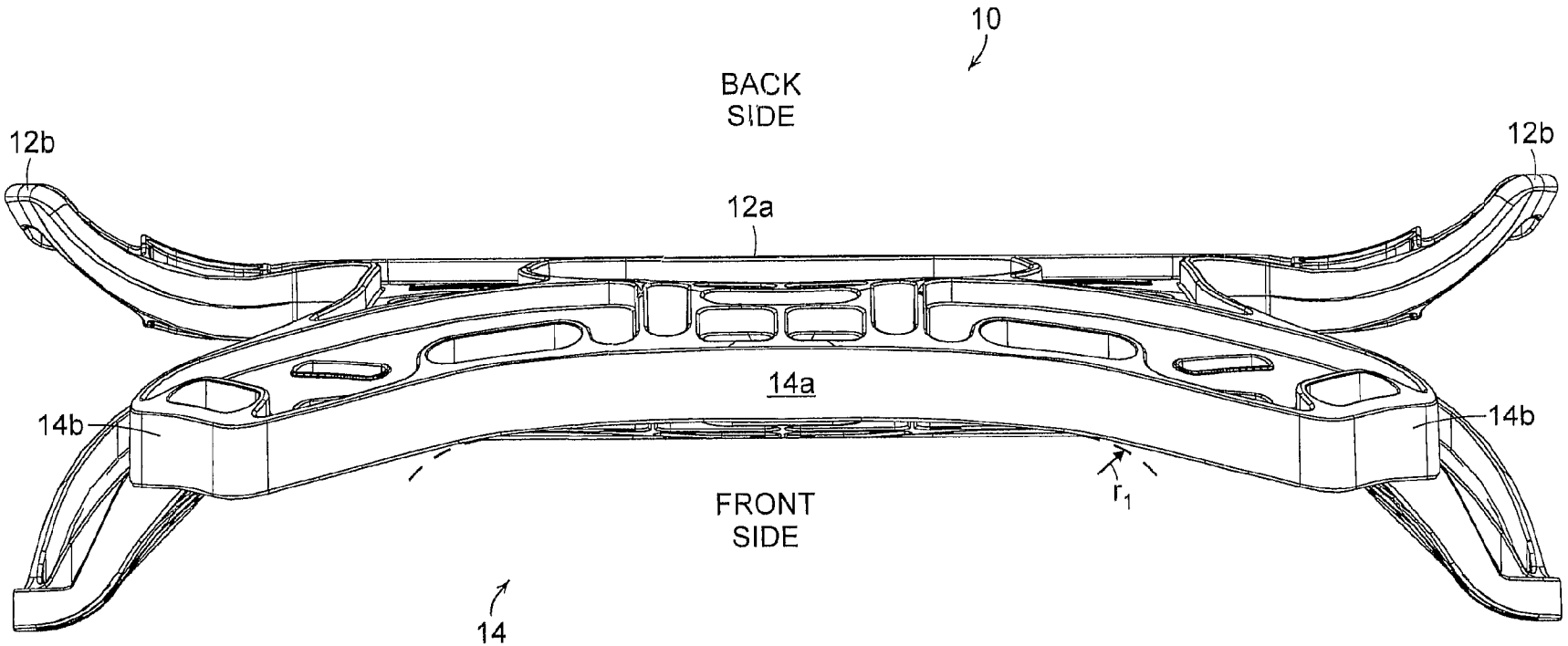
FIGS. 5 and 6 are, respectively, top and bottom end views of the backpack frame.

As shown by the radius "$r_1$" in FIG. 5, the top section 14 has a forwardly concave central area **14*a* with end segments 14*b* also curving forwardly towards the front side of the backpack frame. Additionally, as shown by the radius "$r_2$" in FIG. 3, the top section 14 is longitudinally concave, and as shown by the radius "$r_3$" in FIG. 2, the upper edge of the top section is concave, resulting in a gradual tapering from either end 14*b*** towards the center line X.

Figure 7:
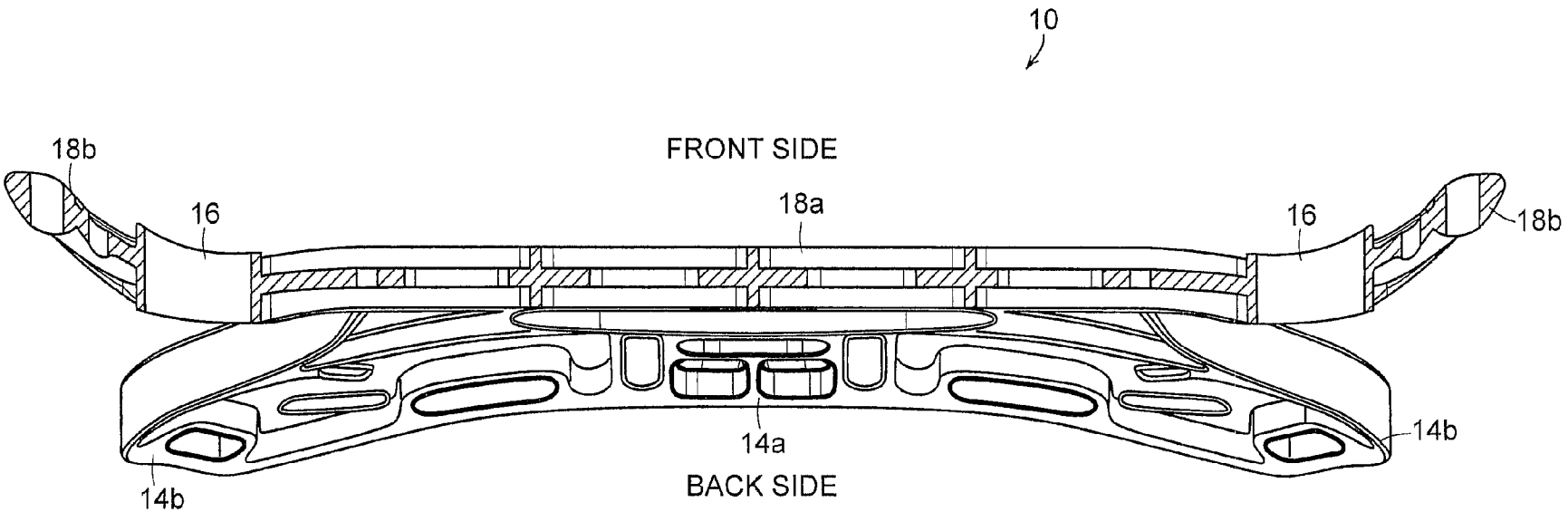
FIG. 7 is a cross sectional view of the backpack frame taken along line 7-7 of FIG. 2.

As can be best seen in FIG. 7, the stabilizing rib 18 has a central area **18*a* with end segments 18*b* that project laterally from the side rails 16 and curve rearwardly towards the back side of the backpack frame. The central area 18*a*** may either be substantially flat, as shown, or slightly forwardly concave.

When the backpack frame is subjected to the torsional forces "F" depicted in FIG. 1, these forces tend to cancel each other out at a transverse axis "Y" hereinafter referred to as the "torsion flex node". The stabilizing rib 18 is preferably located at or slightly above the torsion flex node, i.e., between the top section 14 and the torsion flex node.

Figure 2:
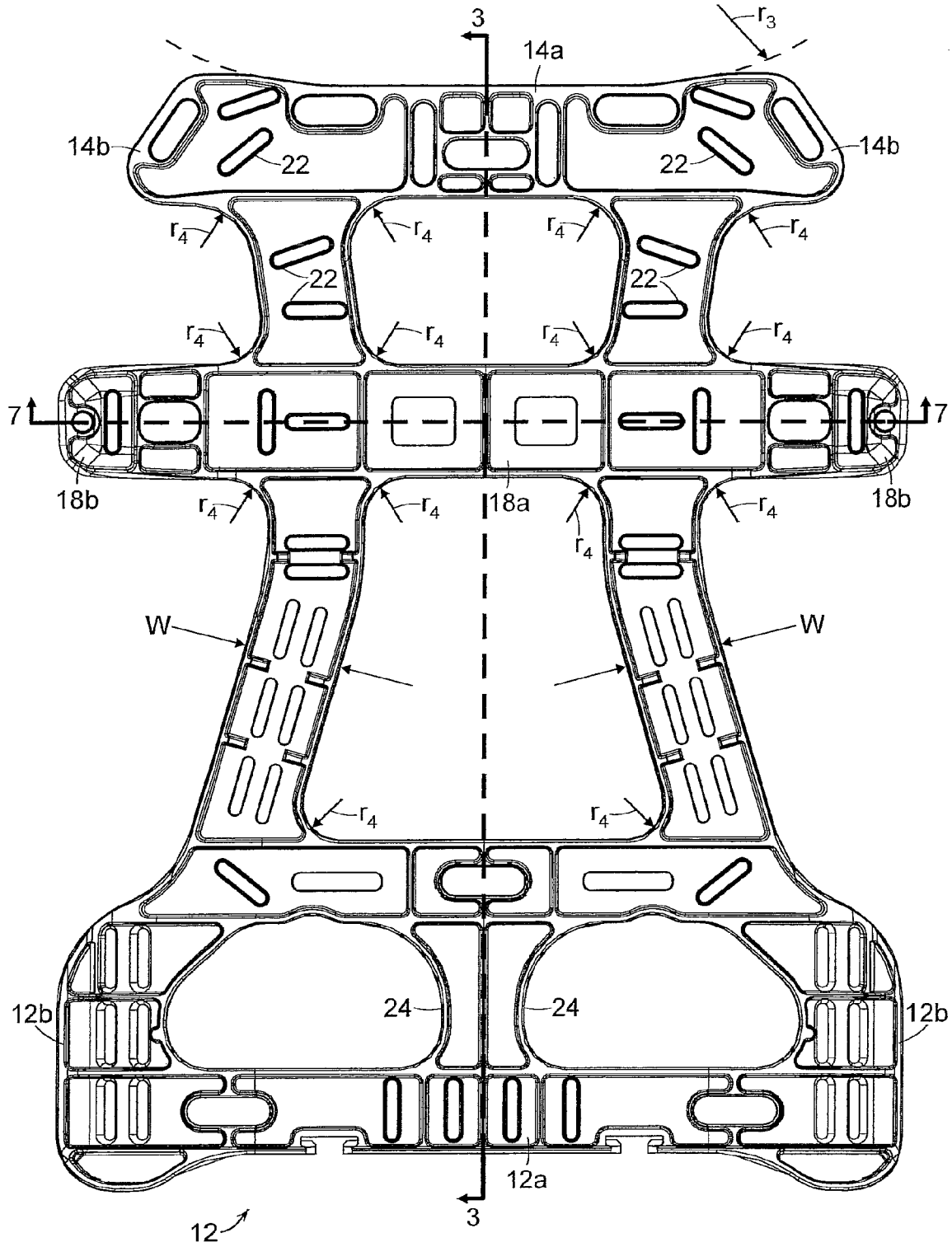
FIG. 2 is a back plan view of the backpack frame.

As can best be seen in FIG. 2, the bottom edge of top section 14 and the top and bottom edges of the stabilizing rib 18 at their respective junctures with the inner and outer edges of the side rails 16 define concavities having radii $r_4$ selected to distribute rather than concentrate torsional stresses, while also controlling the extent of twist by resisting torque. Similar concavities are defined at the juncture between the interior edges of the side rails 16 and the top edge of the base section 12. The radii $r_4$ can range from 25 to 75% of the width "w" of the side rails, with 30 to 70% of the width w being preferable, and with 34 to 56% of the width w being most preferable.

Figure 3:
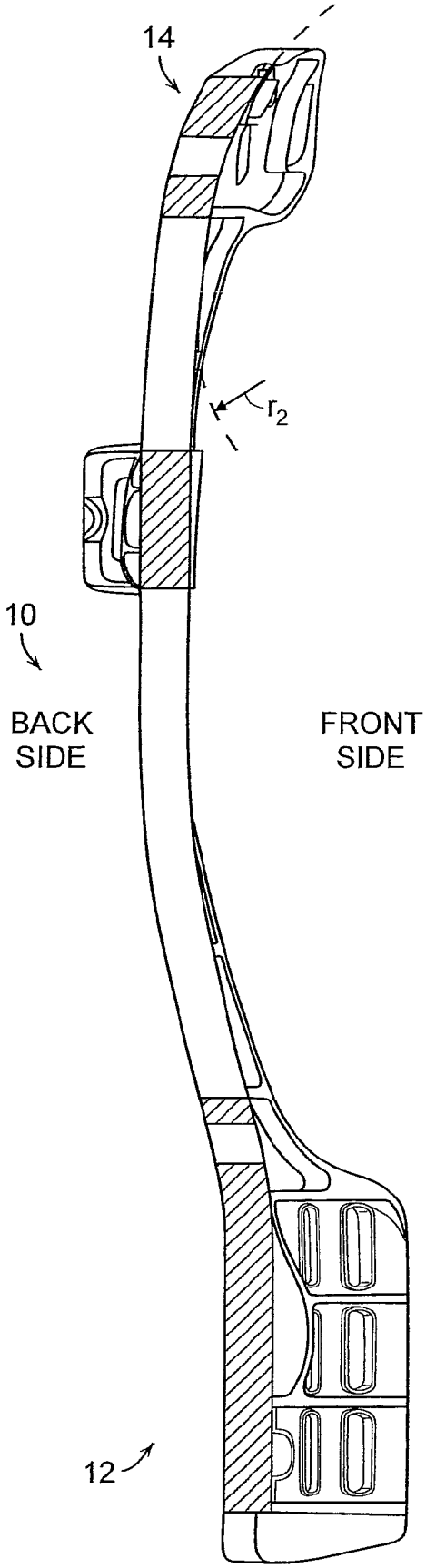
FIG. 3 is a longitudinal sectional view of the backpack frame taken along line 3-3 of FIG. 2.
Figure 4:
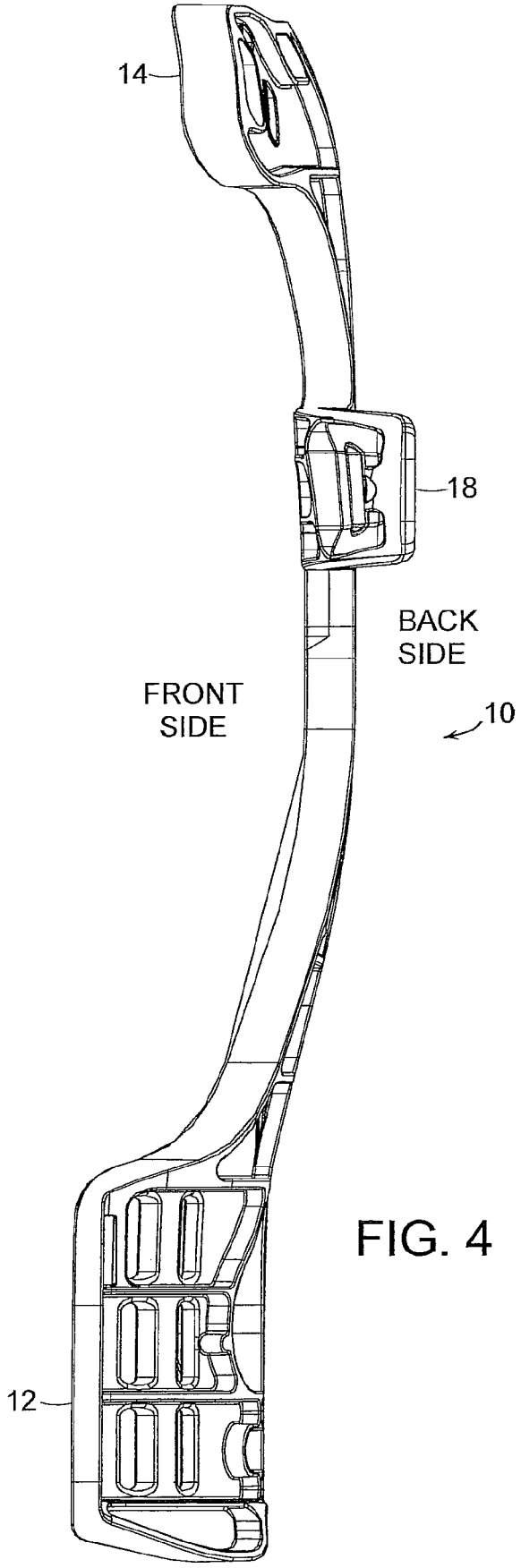
FIG. 4 is a side view of the backpack frame looking from left to right as viewed in FIG. 2.

As can best be seen in FIGS. 3 and 4, the intermediate portion of the backpack frame between the base and top sections 12, 14 defines a concavity facing the front side.

Figure 8:
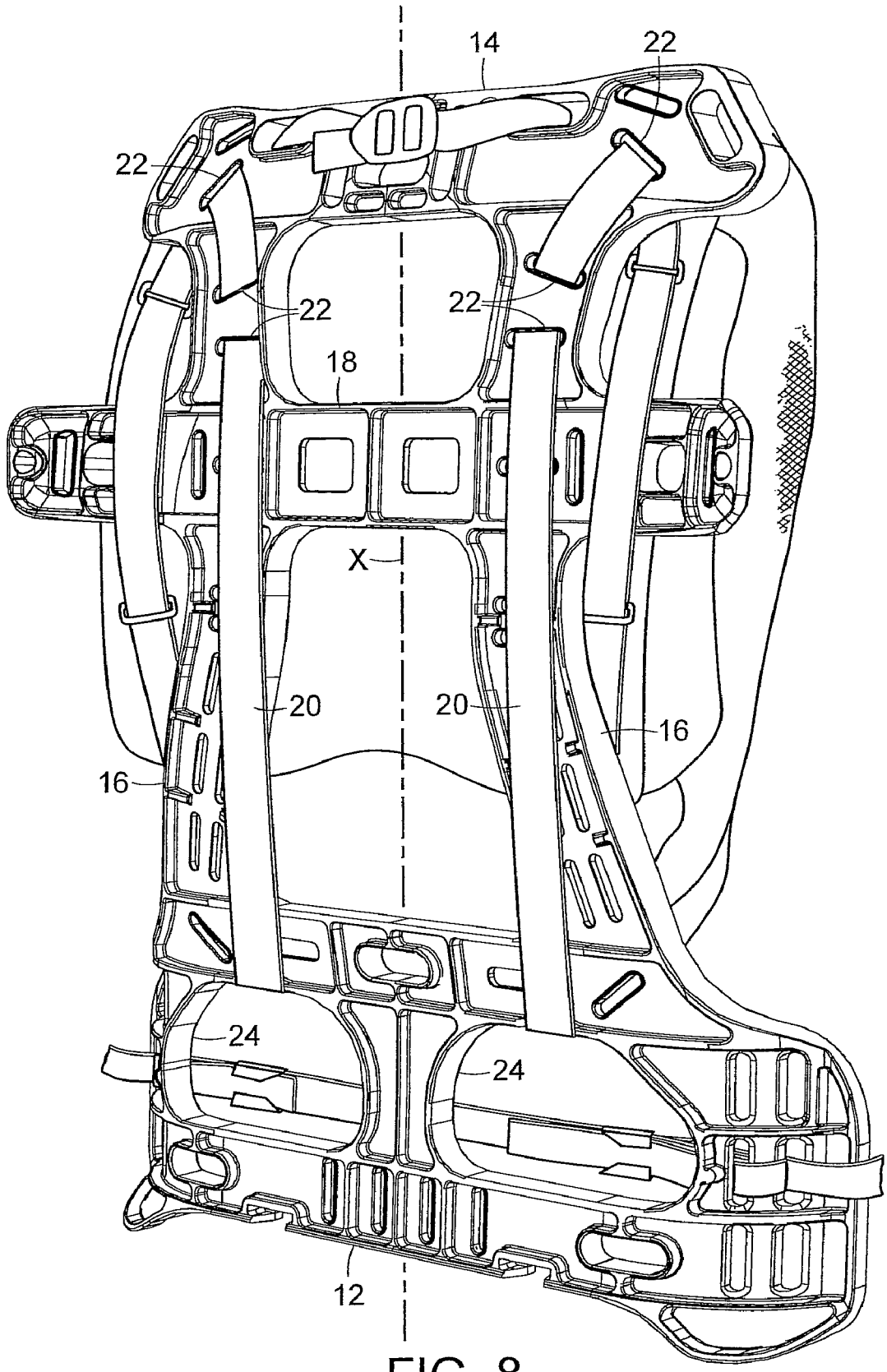
FIG. 8 is a front perspective view of the backpack frame, carrying a load, and showing the addition of control straps to minimize flexure.

Optionally, as shown in FIG. 8, control straps 20 may be applied to the frame on opposite sides of the center line X. The control straps are woven through strategically placed slots 22 at the upper ends of the side rails 16 and the top section 14, and are passed downwardly across the back side of the stabilizing rib 18 and through openings 24 in the base section 12.

The laterally inward contour of the side rails 16 coupled with rearward curvature of the end segments **18*b* of the stabilizing rib 18** coact to provide increased room for the wearer's shoulders, scapulas and forearms to move, thereby facilitating backward and sideward reaching. This is particularly advantageous when the wearer is in a prone position.

The configuration and positioning of the stabilizing rib 18 provides additional significant advantages. More particularly the laterally projecting end segments **18*b* provide a wider base for stabilizing loads. The rearward curvature of the end segments 18*b* provide a functional cradle for the load as well as a structurally sound stabilizing support away from the wearer's back. By locating the stabilizing rib 18** approximately at the torsion flex node, lateral load shifting is minimized as the wearer walks or runs. Positioning the stabilizing rib slightly above the torsion flex node assists in keeping the load center of gravity closer to that of the wearer's body.

The tapered configuration of the top section 14 allows it to twist in relationship to the stabilizing rib 18 to facilitate walking while maintaining sufficient rigidity to stabilize the load. The dual concavity of the top section shown by radii $r_1$ and $r_2$ further assists in accommodating twisting while providing adequate rigidity. Of particular significance are the edge concavities with radii $r_4$ which distribute torsional stresses while additionally controlling the extent of permissible twist. As the top section curves around the wearer's scapulas and progressively curves over the wearer's shoulders, this dual curvature resists any tendency of the load to peel the frame away from the wearer's back.

The optional flex control straps 20 shown in FIG. 8 serve to limit the maximum extent to which the frame can be flexed forward or backward, thus safeguarding the integrity of the frame when it is exposed to catastrophic impacts, excessive loading or intentional abuse.

I claim:

1. A backpack frame having a front side and a back side, said backpack frame comprising:

generally parallel base and top sections extending transversely across and spaced one from the other along a center line of said backpack frame;

side rails connecting said base section to said top section, said side rails being arranged on opposite sides of said center line; and a stabilizing rib interconnecting said side rails, said stabilizing rib extending transversely across said center line at an intermediate location between said base and top sections and having ends projecting laterally outwardly from said side rails, said side rails converging inwardly from said base section towards said center line to join said stabilizing rib, and diverging outwardly from said stabilizing rib and away from said center line to join said top section, the perimeter of said backpack frame being defined by the outermost edges of said bottom and top sections, said side rails and the laterally outwardly projecting ends of said stabilizing rib, and wherein a bottom edge of said top section and bottom and top edges of said stabilizing rib coact at their respective junctures with inner and outer edges of said side rails to define concavities having radii ranging from 25 to 75% of the width of said side rails.

2. The backpack frame of claim 1 wherein said base section has a substantially flat central area with end segments curving forwardly towards said front side.

3. The backpack frame of claim 1 wherein said top section has a forwardly concave central area with end segments curving forwardly towards said front side.

4. The backpack frame of claim 1 wherein said stabilizing rib has a substantially flat central area with said ends curving rearwardly towards said back side.

5. The backpack frame of claim 1 wherein said stabilizing rib has a forwardly concave central area with said ends curving rearwardly towards said back side.

6. A backpack frame having front and back sides, said backpack frame comprising:

generally parallel base and top sections extending transversely across and spaced one from the other along a center line of said backpack frame, said base section having a substantially flat central area and said top section having a forwardly facing concave central area, each of said base and top sections having end segments curving forwardly towards said front side;

side rails connecting said base section to said top section, said side rails being arranged on opposite sides of said center line; and a stabilizing rib interconnecting said side rails and extending transversely across said center line at an intermediate location between said base and top sections, said stabilizing rib having a substantially flat central area with ends projecting laterally outwardly from said side rails and curving rearwardly towards said back side, said side rails converging inwardly from said base section towards said center line to join said stabilizing rib, and diverging outwardly from said stabilizing rib and away from said center line to join said top section, the perimeter of said backpack frame being defined by the outermost edges of said bottom and top sections, said side rails and the laterally outwardly projecting ends of said stabilizing rib and wherein a bottom edge of said top section and bottom and top edges of said stabilizing rib coact at their respective junctures with inner and outer edges of said side rails to define concavities having radii ranging from 25 to 75% of the width of said side rails.

7. The backpack frame of claim 1 or 6 wherein said concavities have radii ranging from 30 to 70% of said width.

8. The backpack frame of claim 1 or 6 wherein said concavities have radii ranging from 34 to 56% of said width.

9. The backpack frame of claim 1 or 6 wherein the inner edges of said side rails also coact with a top edge of said base section to define said convcavities.

* * * * *